US005394724A

United States Patent [19]

Griess et al.

[11] Patent Number: 5,394,724

[45] Date of Patent: Mar. 7, 1995

[54] EDGING ROLL PAIR FOR EDGING FLANGE EDGES OF SYMMETRICAL STEEL SECTIONS

[75] Inventors: Hans-Peter Griess; Manfred Müller, both of Duisburg, Germany

[73] Assignee: Mannesmann Aktiengesellschaft, Dusseldorf, Germany

[21] Appl. No.: 135,670

[22] Filed: Oct. 13, 1993

[30] Foreign Application Priority Data

Oct. 16, 1992 [DE] Germany ..... 42 35 377.7

[51] Int. Cl.[6] ..... B21B 27/02

[52] U.S. Cl. ..... 72/247; 72/252.5; 470/1; 470/38

[58] Field of Search ..... 72/238, 247, 252.5; 470/1, 38, 39

[56] References Cited

U.S. PATENT DOCUMENTS 5,295,380 3/1994 Hioki et al. ..... 72/224

*Primary Examiner*—Lowell A. Larson
*Assistant Examiner*—Thomas C. Schoeffler
*Attorney, Agent, or Firm*—Cohen, Pontani, Lieberman, Pavane

[57] ABSTRACT

A pair of edging rolls for edging the flange edges of symmetrical steel sections, particularly I-girders. Each edging roll has a barrel engaging in the inner contour of the steel section and guiding the section, and two edging paths adjoining the barrel on either side and extending outwardly in a conical shape for the flange edges of the section. The edging paths are arranged at the outer circumference of bushings which are guided so as to be displaceable coaxially at both sides of the barrel on the roll body. The bushings have end faces which face one another and engage in annular recesses of the barrel.

4 Claims, 1 Drawing Sheet

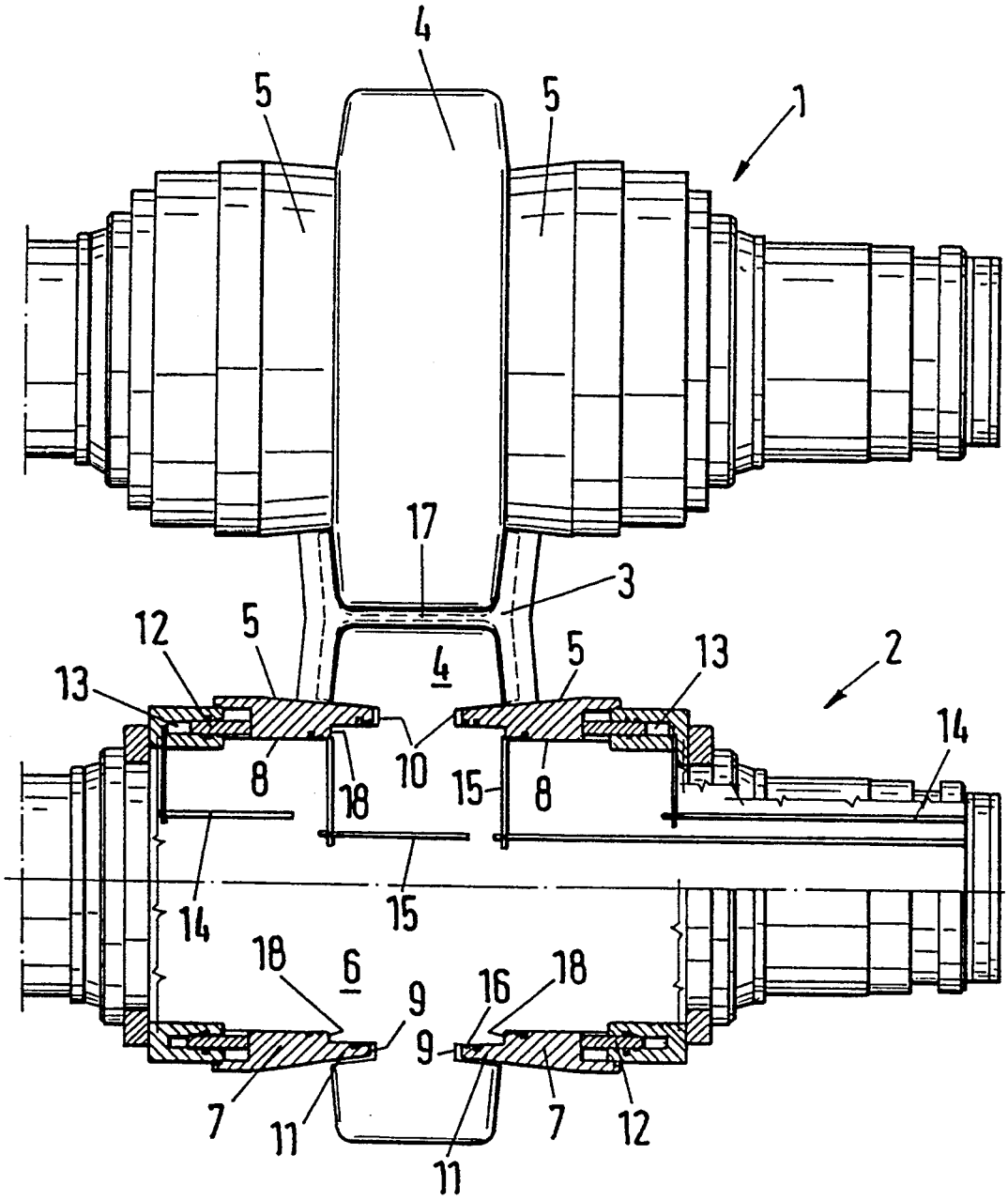
4
5
5
1
17
3
12
5
4
5
13
2
13
14
8
18
10
15
8
14
15
18
6
9
16
18
9
7
11
7
12
11

EDGING ROLL PAIR FOR EDGING FLANGE EDGES OF SYMMETRICAL STEEL SECTIONS

BACKGROUND OF THE INVENTION

1. Field of the Invention

The invention relates to a pair of edging rolls for edging the flange edges of symmetrical steel sections, particularly I-girders. Each edging roll has a barrel engaging in the inner contour of the section and guiding the section and two edging paths adjoining the barrel at either side and extending outwardly in a conical shape for the flange edges of the section.

2. Description of the Prior Art

Rolling mill trains having universal roll stands and edging stands cooperating with the latter are particularly suited for rolling symmetrical steel sections, in particular I-girders. The preliminary section is reduced in the universal stands in a number of successive reversing passes, while the free-spreading flanges are shaped in the edging stands in that their flange edges are upset or edged. In so doing, it is known to use edging rolls having a barrel which guides the section and edging paths for the flange edges adjoining both sides of the barrel. These edging paths are formed by conically extending portions of the roll. The cone extends outward, i.e. the edging paths increase in diameter from the barrel outward.

The barrel of the edging roll engages in the outer contour of the section and guides it in that the barrel flanks contact the inner flanks of the flange of the section. A gap should remain between the outer diameter of the barrel and the web of the section to be rolled so that the different circumferential speeds of the outer diameter of the barrel and the penetration paths do not have a negative effect. However, it must be ensured that the play or clearance between the outer diameter of the barrel and the web of the section is not too great. Otherwise, an exact centering of the section would no longer be possible. The section floats in the roll gap and an unacceptable bending of the flanges and web occurs.

In this respect, a particular problem arises with reversing rolls in successive universal passes and edging passes in that the flange of the section to be rolled widens or spreads in the universal passes and in that—when the dimensions of the edging rolls are fixed—it is no longer possible for the barrel of the edging roll to penetrate to a sufficient depth into the inner contour of the section due to the contact of the edging paths at the edges of the flanges. This results in disadvantageously large play or clearance in the region of the web of the section and in the deformations of the section described above. This problem occurs especially at the end of the pass sequence in girder rolling with only one edging stand, since the difference in diameter between the edging path of the edging roll and the outer diameter of the penetration-rolling barrel is too small. A possibility for changing the excessive clearance between the barrel of the edging roll and the web of the rolling section is described in the European Patent 02 94 494. In this patent, the barrel of the edging roll is formed from two eccentrically supported rings which slide freely on an adjustable bearing body. The position of the outer ring can be changed in relation to the center of the web of the section by adjusting eccentric intermediate rings and the gap of the outer diameter of the roll barrel can accordingly be changed.

The disadvantage of the known solution is that the edging roll entails a very high production cost as a consequence of the eccentrics which are supported relative to one another and at the same time has a high anticipated wear. The eccentric adjustment of the barrel comprising two disks also changes the chamber dimensioning of the roll, which is likewise disadvantageous. The previously known solution can also not be installed subsequently in existing roll stands because this would necessitate extensive remodeling.

SUMMARY OF THE INVENTION

Based on the prior art described above and the known disadvantages, the present invention has the object of providing an edging roll of simple construction for an edging roll pair for edging the flange edges of symmetrical steel sections so as to enable an exact adjustment of the center position of the sections with optimum guidance in the case of spread flanges. The edging roll is also constructed so as to be installable in existing roll stands.

Pursuant to this object, and others which will become apparent hereafter, one aspect of the present invention resides in each edging roll of a pair of edging rolls having a barrel that engages in the inner contour of a steel section to be edged and guides the section. Each roll having two edging paths that adjoin the barrel on either side and extend outward in a conical shape for the flange edges of the steel section. The edging paths are formed by the outer circumference of bushings which are guided so as to be displaceable coaxially at both sides of the barrel on the roll body. The end faces of the bushings which face one another engage in annular recesses of the barrel.

Departing from the teaching of the prior art, the present invention suggests that the edging paths, and not the barrels of the edging roll, be constructed so as to be adjustable in that the edging paths are axially displaceable. Due to the conical construction of the edging paths, their effective vertical position changes with axial displacement. This change in the vertical position is made use of for the purpose of varying the diameter of the edging path.

The end faces of the conical bushings at the outer circumference engage in annular recesses of the barrel of the edging roll with a part of the bushing so that the smallest diameter of the edging path is effective in the outermost displaced axial position of the bushings. However, the edging path and side flank of the barrel of the edging roll still provide sufficient guidance for the section. The adjustment path and changeable diameter of the edging path are adapted to the necessary difference in diameter between the edging path and outer diameter of the barrel and are correspondingly designed.

The bushings are preferably displaceable hydraulically, although mechanical displacement is, of course, also possible.

According to another embodiment of the invention, the axial depth of the annular recesses of the barrel is greater than the portion of the respective bushing which can move into the recesses and corresponds at least to the displacement distance or path of the respective bushing. This ensures a constantly secure support of the edging path.

The various features of novelty which characterize the invention are pointed out with particularity in the claims annexed to and forming a part of the disclosure.

For a better understanding of the invention, its operating advantages, and specific object attained by its use, reference should be had to the drawing and descriptive matter in which there are illustrated and described preferred embodiments of the invention.

BRIEF DESCRIPTION OF THE DRAWING

The drawing shows a pair of edging rolls pursuant to the present invention.

DETAILED DESCRIPTION OF THE PREFERRED EMBODIMENTS

A pair of edging rolls pursuant to the present invention includes an upper edging roll 1 and a lower edging roll 2 which edge an I-section 3 in several passes between interceding universal passes. The edging rolls 1 and 2 include a barrel 4 and edging paths 5 which extend outward conically at both sides of the barrel 4.

As can be seen at the lower edging roll 2, which is shown in partial section, the barrel 4 is part of a roll body 6, while the edging paths 5 are provided at the outer surface of conical bushings 7 which are displaceable axially on cylindrical sliding portions 8 of the roll body 6. The end faces 9 of the bushings 7 project into annular recesses 10 of the roll body 6 in the region of the barrel 4 together with portions 11 of the conical bushings 7 whose length corresponds approximately to the displacement path of the conical bushings 7.

Ring pistons 12, whose piston spaces 13 can be acted upon by a liquid pressure medium via lines 14, are provided for displacing the conical bushings 7. Each bushing 7 accordingly moves into an end position, shown in the drawing, in which the portion 11 of the bushings 7 penetrates deeply into the recesses 10 of the roll body 6.

The bushings 7 can be displaced outwardly in that the pressure medium acts on the piston surfaces 18 via the lines 15 when the lines 14 are opened in a corresponding manner and the portions 11 are partially guided out of the annular recesses 10. In so doing, the bushings 7 slide on the sliding surfaces 8 and the portions 11 slide in the recesses 10 at 16 so that the bushing 7 is always supported relative to the roll body 6.

As the bushings 7 move outward, the diameter of the edging paths acting on the flange edges decreases so that a larger flange width can be worked on without a change in the depth of penetration of the barrel 4 into the regions of the web 17 of the I-section 3. The adjustment of the bushings 7 can easily be carded out during the rolling operation between two edging passes so that the edging roll 1, 2 can easily be adapted to the required edging process so as to operate in a reliable manner in a simple construction.

A particular advantage of the invention is that the device according to the invention can also be mounted subsequently in conventional edging rolls without weakening the stability of the roll in an objectionable manner.

The invention is not limited by the embodiments described above which are presented as examples only but can be modified in various ways within the scope of protection defined by the appended patent claims.

We claim:

1. A pair of edging rolls for edging flange edges of a symmetrical steel section, each edging roll comprising: a roll body having a barrel engagable in an inner contour of the steel section and guiding the section, the barrel having annular recesses; and, two bushings provided on both sides of the barrel so as to be coaxially displaceable on the roll body, the bushings each having an outer circumference that forms an edging path so that the two edging paths adjoin the barrel on either side and extend outward in a conical shape for engaging the flange edges of the steel section, the bushings further having end faces which face one another and engage in the annular recesses of the barrel.

2. A pair of edging rolls according to claim 1, wherein the bushings are hydraulically displaceable.

3. A pair of edging rolls according to claim 1, wherein the bushings have projecting portions on which the end faces are located, which portions are moveable into the annular recesses, the annular recesses of the barrel having an axial depth that is greater than the length of the portions of the bushings which are moveable into the recesses and corresponds at least to a displacement path of the bushings.

4. A pair of edging rolls according to claim 1, and further comprising means for displacing the bushings on the roll body.

* * * * *